US008844853B2

(12) United States Patent
Hongo

(10) Patent No.: US 8,844,853 B2
(45) Date of Patent: Sep. 30, 2014

(54) REDUCING COMPONENT FOR A COMMINUTION MACHINE

(75) Inventor: Tadahiro Hongo, Tokyo (JP)

(73) Assignee: Vermeer Manufacturing Company, Pella, IA (US)

( * ) Notice: Subject to any disclaimer, the term of this patent is extended or adjusted under 35 U.S.C. 154(b) by 29 days.

(21) Appl. No.: 13/820,355

(22) PCT Filed: Sep. 2, 2010

(86) PCT No.: PCT/US2010/047702

§ 371 (c)(1),
(2), (4) Date: Mar. 1, 2013

(87) PCT Pub. No.: WO2012/030345

PCT Pub. Date: Mar. 8, 2012

(65) Prior Publication Data

US 2013/0161428 A1 Jun. 27, 2013

(51) Int. Cl.

| | |
|---|---|
| ***B02C 23/00*** | (2006.01) |
| ***B02C 13/28*** | (2006.01) |
| ***B02C 18/14*** | (2006.01) |
| ***B02C 18/18*** | (2006.01) |
| ***B02C 13/284*** | (2006.01) |
| ***B02C 23/10*** | (2006.01) |
| *B02C 23/16* | (2006.01) |

(52) U.S. Cl.

CPC ..... *B02C 13/2804* (2013.01); *B02C 18/145* (2013.01); *B02C 18/18* (2013.01); *B02C 2023/165* (2013.01); *B02C 13/284* (2013.01); *B02C 23/10* (2013.01)

USPC ..... 241/294

(58) Field of Classification Search

USPC ..... 241/294, 293, 189.1

See application file for complete search history.

(56) References Cited

U.S. PATENT DOCUMENTS

| | | | |
|---|---|---|---|
| 2,386,021 | A | 10/1945 | Wetmore |
| 3,963,183 | A | 6/1976 | Paulsen |
| 4,505,434 | A | 3/1985 | Martens et al. |
| 5,372,316 | A | 12/1994 | Bateman |
| 5,413,286 | A | 5/1995 | Bateman |
| 5,507,441 | A | 4/1996 | De Boef et al. |
| 5,803,380 | A | 9/1998 | Brand |
| 5,950,942 | A | 9/1999 | Brand et al. |
| 6,059,210 | A | 5/2000 | Smith |

(Continued)

FOREIGN PATENT DOCUMENTS

| | | | |
|---|---|---|---|
| DE | 10 2005 023 567 | A1 | 11/2006 |
| EP | 1 990 399 | A1 | 11/2008 |

(Continued)

*Primary Examiner* — Faye Francis

(74) *Attorney, Agent, or Firm* — Merchant & Gould P.C

(57) ABSTRACT

A reducing component is disclosed herein. The reducing component includes a block-style reducer including a height, a width and a depth. The block-style reducer includes first and second ends separated by the height, first and second sides separated by the width and front and back sides separated by the depth. The block-style reducer also includes a first reducing edge that extends across the width of the block-style reducer at a location adjacent to the first end of the block-style reducer. The reducing component also includes a blade-style reducer that projects forwardly from the block-style reducer at a location adjacent the second side of the block-style reducer. The blade-style reducer includes a second reducing edge that extends primarily along the height of the block-style reducer.

16 Claims, 12 Drawing Sheets

(56) References Cited

U.S. PATENT DOCUMENTS

| | | | | |
|---|---|---|---|---|
| 6,227,469 | B1 | 5/2001 | Daniels, Jr. et al. | |
| 6,293,481 | B1 * | 9/2001 | Ragnarsson | 241/197 |
| 6,394,375 | B1 | 5/2002 | Balvanz et al. | |
| 6,412,715 | B1 | 7/2002 | Brand et al. | |
| 6,422,495 | B1 | 7/2002 | De Boef et al. | |
| 6,517,020 | B1 | 2/2003 | Smith | |
| 6,520,440 | B2 * | 2/2003 | Ragnarsson | 241/294 |
| 6,622,951 | B1 | 9/2003 | Recker et al. | |
| 6,840,471 | B2 | 1/2005 | Roozeboom et al. | |
| 6,843,435 | B2 | 1/2005 | Verhoef et al. | |
| 6,845,931 | B1 | 1/2005 | Smith | |
| 7,077,345 | B2 | 7/2006 | Byram et al. | |
| 7,204,442 | B2 | 4/2007 | Roozeboom et al. | |
| 7,213,779 | B2 | 5/2007 | Roozeboom et al. | |
| 7,293,729 | B2 * | 11/2007 | Ragnarsson | 241/197 |
| 7,461,802 | B2 | 12/2008 | Smidt et al. | |
| 7,959,097 | B2 | 6/2011 | De Boef | |
| 7,971,818 | B2 | 7/2011 | Smidt et al. | |
| 8,061,640 | B2 * | 11/2011 | Cotter et al. | 241/101.01 |
| 8,104,701 | B2 | 1/2012 | Smidt et al. | |
| 8,245,961 | B2 | 8/2012 | Vroom et al. | |
| 2003/0085310 | A1 | 5/2003 | Galanty et al. | |
| 2004/0159725 | A1 | 8/2004 | Irwin | |
| 2004/0251346 | A1 | 12/2004 | Verhoef et al. | |
| 2005/0001083 | A1 | 1/2005 | Cook et al. | |
| 2005/0098671 | A1 | 5/2005 | Verhoef et al. | |
| 2005/0121550 | A1 | 6/2005 | Smith | |
| 2006/0043226 | A1 | 3/2006 | Roozeboom et al. | |
| 2006/0102762 | A1 * | 5/2006 | Garcia et al. | 241/294 |
| 2008/0061176 | A1 * | 3/2008 | Smith | 241/189.1 |
| 2010/0068121 | A1 | 3/2010 | Park et al. | |
| 2011/0266382 | A1 * | 11/2011 | Labbe et al. | 241/294 |

FOREIGN PATENT DOCUMENTS

| | | | |
|---|---|---|---|
| JP | 2000-354785 | A | 12/2000 |
| JP | 2006-122894 | A | 5/2006 |
| WO | WO 03/066296 | A1 | 8/2003 |

* cited by examiner

REDUCING COMPONENT FOR A COMMINUTION MACHINE

This application is a National Stage Application of PCT/US2010/047702, filed on 2 Sep. 2010 and which application is incorporated herein by reference. To the extent appropriate, a claim of priority is made to each of the above disclosed applications.

TECHNICAL FIELD

The present disclosure relates generally to reducing components for comminution machines. In particular, the present disclosure relates to reducing components for comminution machines such as grinders and chippers.

BACKGROUND

Comminution machines are used to reduce waste materials such as trees, brush, stumps, pallets, root balls, railroad ties, peat moss, paper, wet organic materials, fibrous materials such as empty fruit bunches and the like. Two common types of comminution machines include grinders and chippers. Grinders are typically configured to reduce material through blunt force impactions. Thus, the reduced material product generated by grinders generally has a ground, flattened texture with relatively high fines content. This type of reduced material is typically used as mulch. In contrast to the blunt force action used by grinders, chippers reduce material through a chipping action. The reduced product generated by chippers preferably has a relatively small percentage of fines. This type of chipped reduced product can readily be used as fuel for a burner since the material is more flowable than ground reduced material and can easily be handled by the material processing equipment used to feed fuel to a burner.

Grinders typically include reducing hammers on which replaceable grinding cutters (i.e., grinding tips or grinding elements) are mounted. Grinding cutters generally have relatively blunt ends suitable for reducing material through blunt force impactions. Screens are often used to control the size of the reduced material output from grinders. In contrast to the grinding cutters used on grinders, chippers typically include relatively sharp chipping knives configured to reduce material through a cutting/slicing action as opposed to a grinding action.

SUMMARY

Aspects of the present disclosure relate to reducing components for a comminution machine. In certain embodiments, the reducing components can include block-style reducers combined with blade-style reducers.

DETAILED DESCRIPTION

Figure 1:
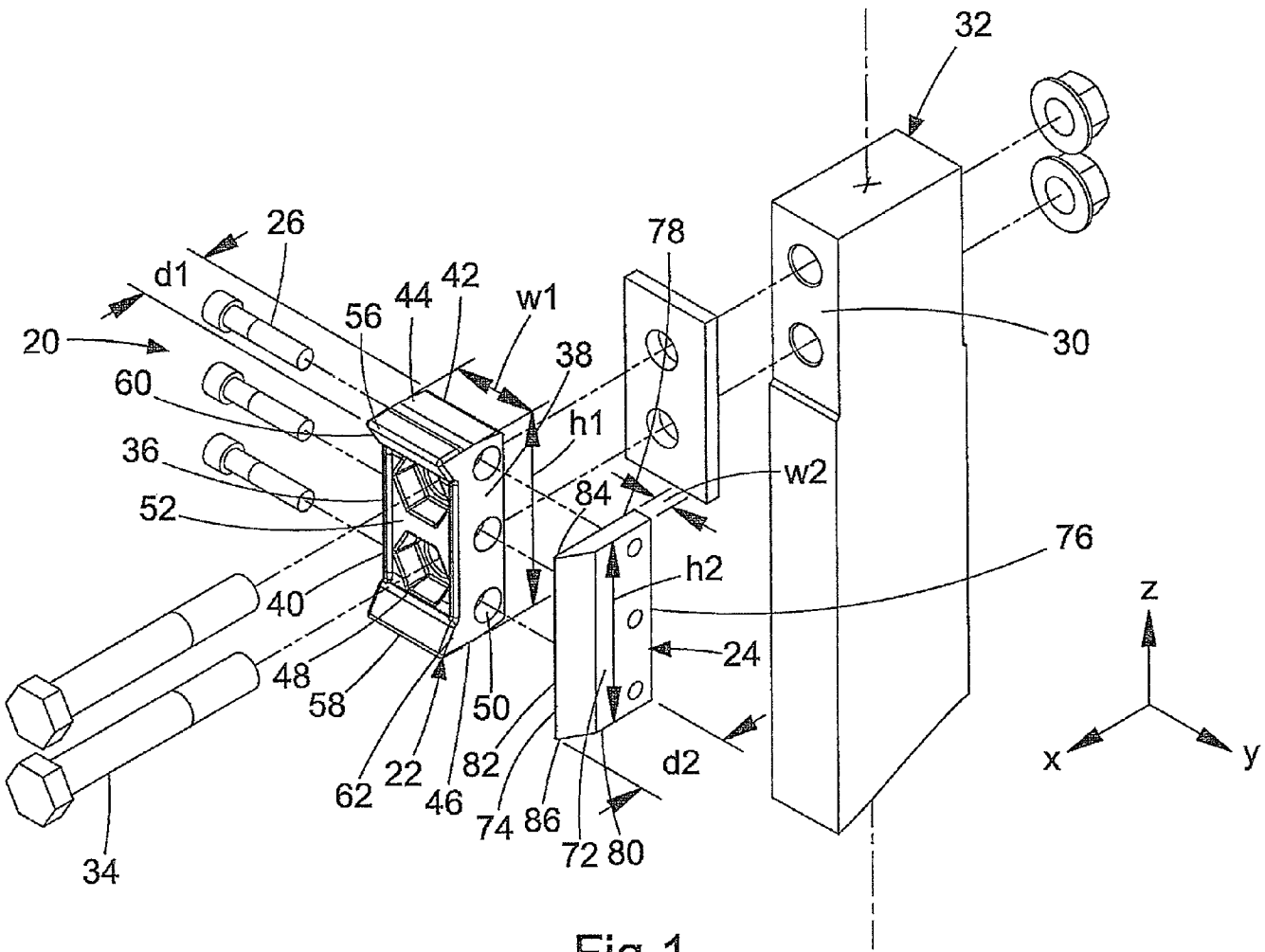
FIG. 1 is an exploded, perspective view of a reducing component in accordance with the principles of the present disclosure.

With reference now to the various figures in which identical components are numbered identically throughout, a description of various exemplary aspects of the present disclosure will now be provided. The disclosed embodiments are shown in the drawings and described with the understanding that the present disclosure is to be considered an exemplification of certain inventive aspects and is not intended to limit the inventive aspects to the embodiments disclosed.

Comminution machines in accordance with the principles of the present disclosure can include rotary reducing units used to reduce material through comminution actions such as grinding, cutting, chopping, slicing, chipping, etc. The rotary reducing units can include carriers (e.g., drums or other carriers as disclosed at U.S. Pat. Nos. 7,204,442; 5,507,441; 7,213,779; and 6,840,471 that are hereby incorporated by reference) that carrying a plurality of reducing components (e.g., edges, grinding members, cutters, plates, blocks, blades, bits, teeth, hammers, shredders or combinations thereof) around rotational cutting paths surrounding central axes of rotation of the carriers. In use, the carriers are rotated about their axes to cause the reducing components to impact material desired to be reduced thereby causing reduction of the material via one or more comminution actions. Screen can be provided at least partially surrounding the rotary reducing units for providing additional comminution action and for controlling the size of the reduced material output from the comminution machines. Example comminution machines in accordance with the principles of the present disclosure can include tub grinders, horizontal grinders, chippers, shredders or other material reduction machines.

Figure 2:
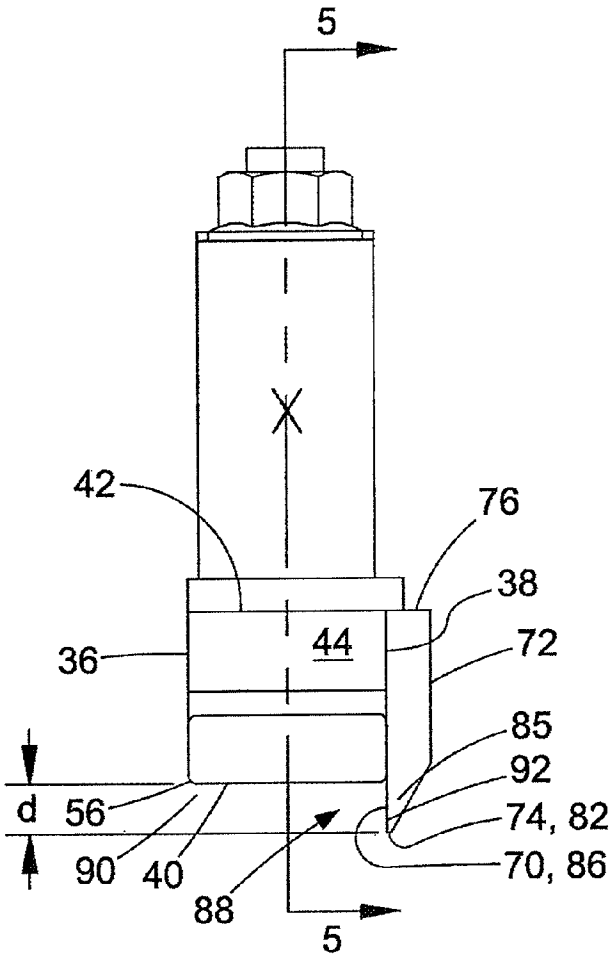
FIG. 2 is a top view of the reducing component of FIG. 1 in an assembled state.

FIGS. 1 and 2 illustrate an example reducing component 20 in accordance with the principles of the present disclosure. The reducing component 20 includes a block-style reducer 22 in combination with a blade-style reducer 24 positioned at one side of the block-style reducer 22. In the embodiment of FIG. 1, the blade-style reducer 24 is removably fastened to one side of the block-style reducer 22 via fasteners 26. However, in other embodiments, the blade-style reducer 24 can be integrally formed/cast as a single piece with the block-style reducer 22 or otherwise fixedly connected (e.g., welded) to the block-style reducer 22. FIGS. 8-11 show an alternative reducing component 20*a* having a block-style reducer 22*a* integrally formed as a single piece with a blade-style reducer 24*a*.

The reducing component 20 of FIGS. 1 and 2 is adapted to be mounted to a leading face 30 of a bar-style hammer 32 via fasteners 34. However, it will be appreciated that in other embodiments the reducing component 20 can be mounted to other styles of hammers or can be mounted directly to drums or other types of rotational carriers.

For ease of description, reference x, y and z axes have been provided at FIG. 1. The x, y and z axes are all perpendicular to one another. The block-style reducer 22 is generally rectangular and includes a height h1 that extends along the z-axis, a width w1 that extends along the y-axis and a depth d1 that extends along the x-axis. The height h1 is larger than the width w1 and the width w1 is larger than the depth d1. The block-style reducer 22 includes first and second sides 36, 38 separated by the width w1. The block-style reducer 22 also includes front and back sides 40, 42 separated by the depth d1. The block-style reducer 22 further includes first and second ends 44, 46 separated by the height h1.

Openings 48 extend through the depth d1 of the block-style reducer 22 for receiving the fasteners 34 used to secure the reducing component 20 to the hammer 32. The fasteners 34 extend along the x-axis. Openings 50 extend through the width w1 of the block-style reducer 22 for receiving the fasteners 26 used to secure the blade-style reducer 24 to the block-style reducer 22. The fasteners 26 extend along the y-axis.

The front side 40 of the block-style reducer 22 can be referred to the "reducing side" or "leading side" of the block-style reducer 22. During the reduction of material, the block-style reducer 22 is moved such that the front side 40 leads the block-style reducer and impacts the material desired to be reduced. The front side 40 of the block-style reducer 22 includes a main central region 52 (i.e., a main central face) through which the openings 48 extend. The openings 48 are countersunk at the main central region 52 for receiving heads of the fasteners 48. The front side 40 also includes reducing edges 56, 58 positioned on opposite sides of the main central region 52. The reducing edges 56, 58 extend across the width w1 of the block-style reducer 22. The reducing edges are parallel to one another and both extend along the y-axis. The first reducing edge 56 is formed by a first wedge-like element 60 that projects forwardly from the main central region 52 at a location adjacent to the first end 44 of the block-style reducer 22. The second reducing edge 58 is formed by a second wedge-like element 62 that projects forwardly from the main central region 52 at a location adjacent to the second end 46 of the block-style reducer 22. The edges 56, 58 are located at front-most portions of the wedge-like elements 60, 62 and can have a rounded/blunt configuration adapted for grinding material desired to be reduced. The wedge-like elements 60, 62 are each formed by surfaces 64, 66 (see FIG. 5) that converge as the surfaces 64, 66 extend forwardly toward the edges 56, 58. In other embodiments, the edges 56, 58 can be sharp edges such as knife edges adapted for chipping material being reduced.

Figure 15:
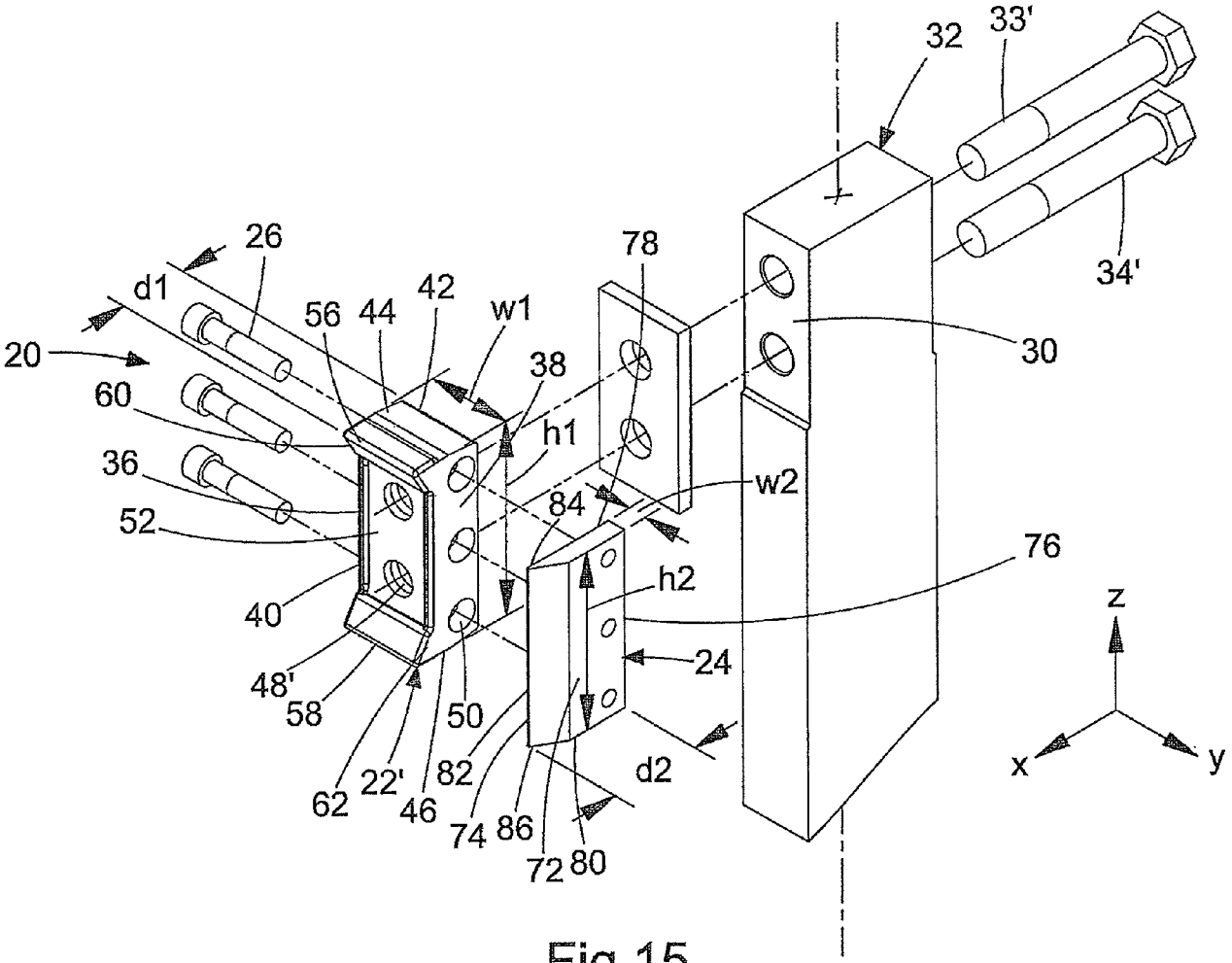
FIG. 15 shows an alternative fastening configuration for securing block-style reducers to a hammer.

FIG. 15 shows an alternative fastening arrangement for securing a block-style reducer 22' to one of the hammers 32. The block-style reducer 22' includes internally threaded openings 48' that receive threaded ends 33' of fasteners 34' used to secure the block-style reducer 22' to the hammer 32. The fasteners 34' extend through openings in the hammer 32 and heads of the fasteners are protected behind back sides of the hammers 32.

The blade-style reducer 24 includes a height h2 that extends along the z-axis, a width w2 that extends along the y-axis and a depth d2 that extends along the x-axis. The height h2 is larger than the depth d2 and the depth d2 is larger than the width w2. The blade-style reducer 24 includes first and second sides 70, 72 separated by the width w2. The blade-style reducer 24 also includes front and back ends 74, 76 separated by the depth d2. The blade-style reducer 24 further includes first and second ends 78, 80 separated by the height h2. The front end 74 of the blade-style reducer 24 comprises a reducing edge 82 that extends along the z-axis and along the height h2. The reducing edge 82 has opposite first and second ends 84, 86 (see FIG. 5) separated from one another by the height h2. In one embodiment, the reducing edge 82 can include a knife edge adapted for cutting, chipping or slicing material desired to be reduced. In one embodiment, the reducing edge 82 is sharper than the reducing edges 56, 58. The reducing edge 82 is formed by a wedge-like element 85 (see FIG. 2) having surfaces that converge as the surface extend forwardly toward the reducing edge 82. In other embodiments, the reducing edge 82 can have a blunt configuration or a squared configuration.

The blade-style reducer 24 mounts to the second side 38 of the block-style reducer 22. As shown at FIG. 2, the wedge-like element 85 projects forwardly from the front side 40 of the block-style reducer 22 with the reducing edge 82 extending parallel to the height h1 of the block-style reducer 22. When viewed in plan view from the front of the assembly, the reducing edge 82 is perpendicular to the edges 56, 58. The reducing edge 82 is forwardly offset a distance d with respect to the edges 56, 58 (see FIG. 2). A forward portion 86 of the first side 70 of the blade-style reducer projects forwardly beyond the main central region 52 of the front side of the block-style reducer 22 such that the front side of the block-style reducer 22 and the forward portion 86 cooperate to define a pocket 88 (see FIG. 2). The pocket 88 has an open side 90 adjacent the first side of the block-style reducer 22 and a closed side 92 adjacent the second side of the block-style reducer 22.

Figure 3:
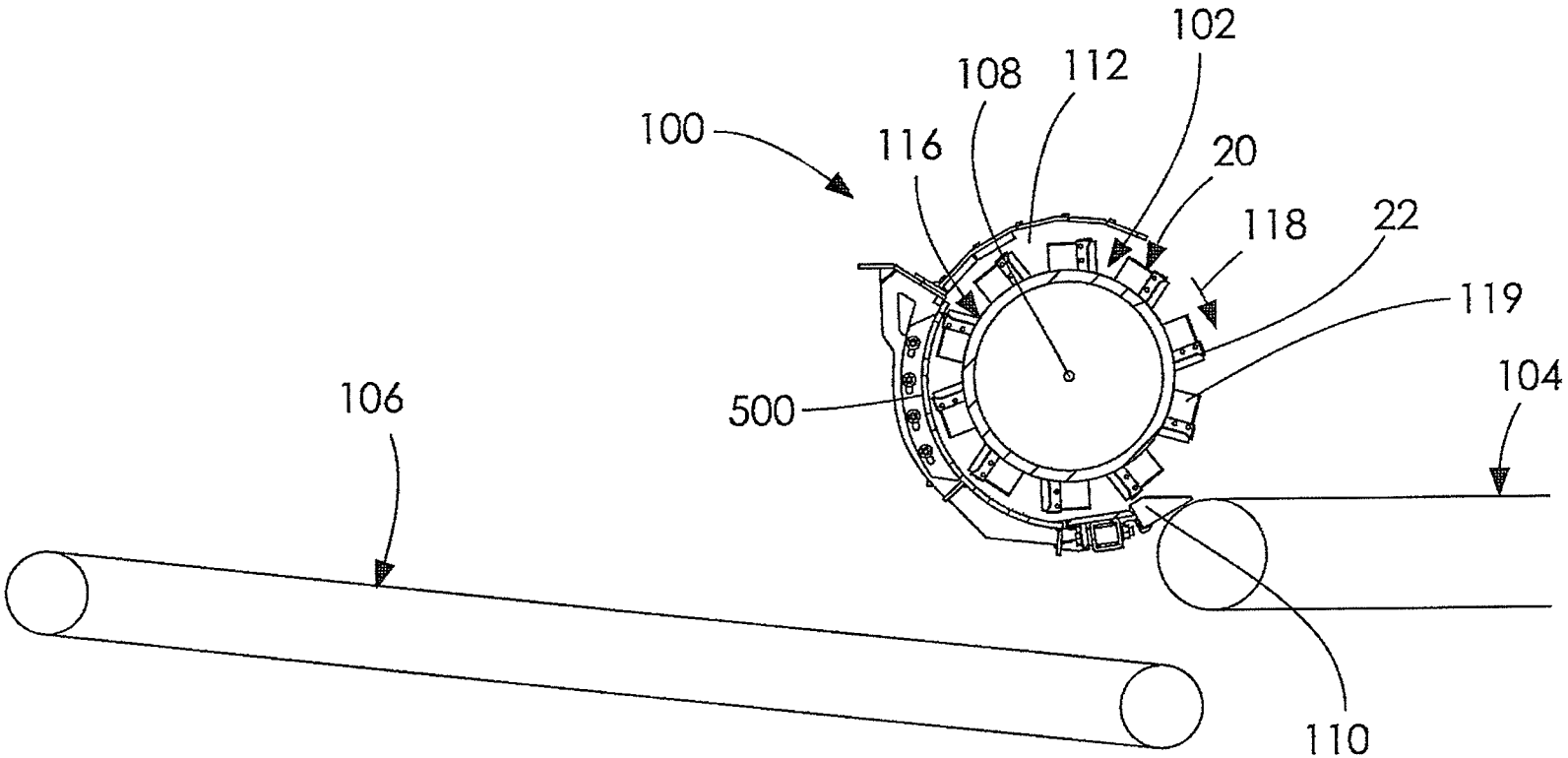
FIG. 3 shows a plurality of the reducing components of FIG. 1 incorporated into a rotational reducing unit that is part of a comminution machine.

FIG. 3 schematically shows a comminution machine 100 (e.g., a horizontal grinder) having a rotational reducing unit 102 including a plurality of the reducing components 20. The comminution machine 100 also includes an in-feed system 104 (e.g., a conveyor) for conveying material desired to be reduced to the reducing unit 102, and a discharge system 106 for carrying reduced material away from the reducing unit 102. In use of the comminution machine 100, the rotational reducing unit is rotated (e.g., by a drive mechanism) about a central axis 108 causing the reducing components 20 to be spun along a reducing perimeter RP (e.g., an outermost reducing diameter, see FIG. 5) that surrounds the axis of rotation 108. While the rotational reducing unit 102 is rotating, material desired to be reduced is loaded into the in-feed system 104 which conveys the material toward the rotating reducing unit 102 and into the reducing perimeter RP. When the material intersects the reducing perimeter RP, the material is impacted by the reducing components 20 and initially reduced. Contact between the material and the reducing unit 102 forces the material past an anvil 110 (one example of a suitable anvil is described in more detail in U.S. Pat. No. 7,461,802 which is incorporated herein by reference) into a comminution chamber 112. The comminution chamber 112 is defined between the reducing unit 102 and a sizing screen 500. Within the comminution chamber 112; the material is ground and sliced by the reducing components 20 and reduced material passes through openings in the sizing screen 500 to the discharge system 106. The discharge system 106 carries the reduced material away from the comminution chamber 112 to a collection location.

Figure 4:
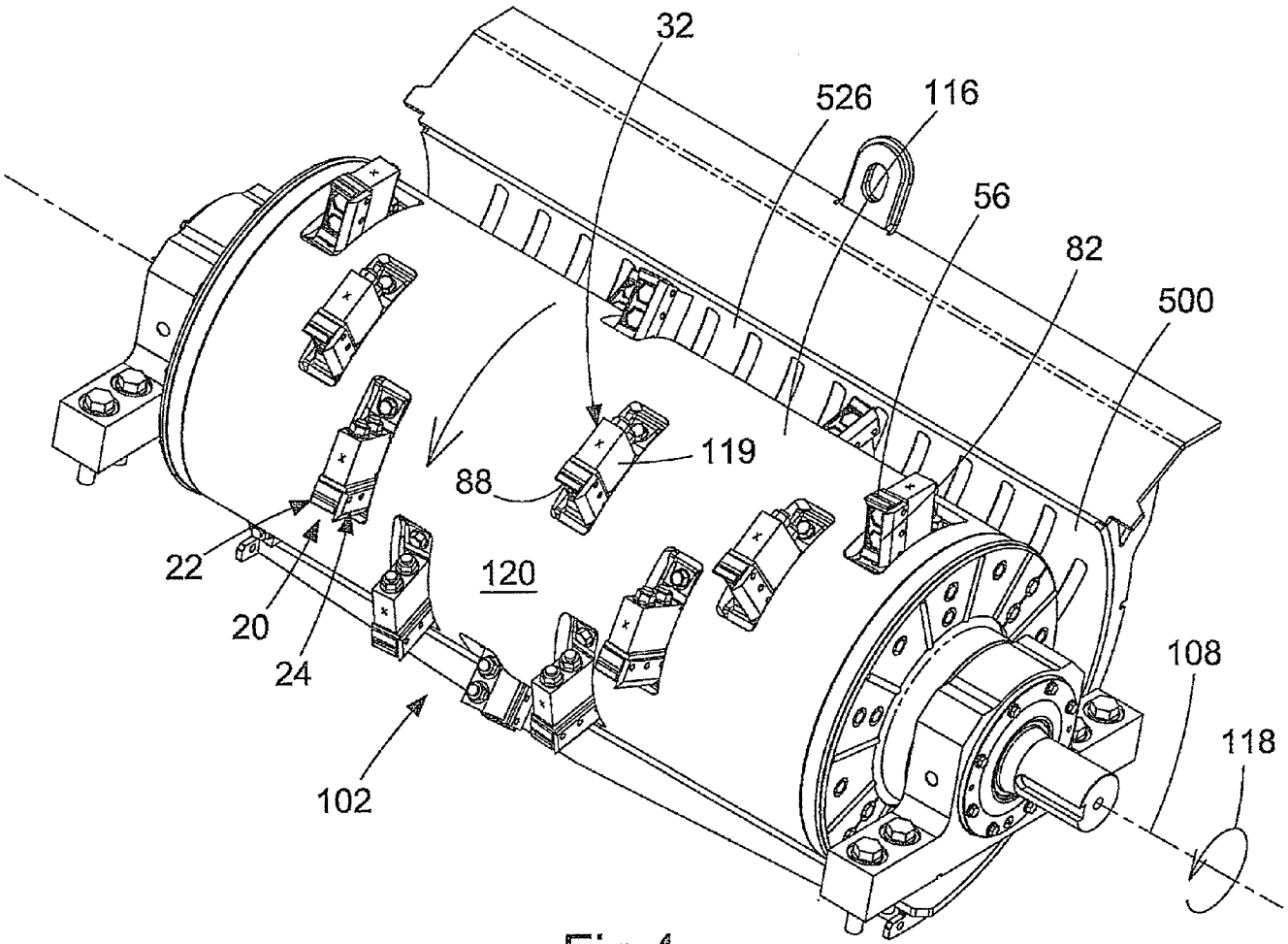
FIG. 4 is a perspective view of the reducing unit of FIG. 3 shown adjacent to a sizing screen.
Figure 5:
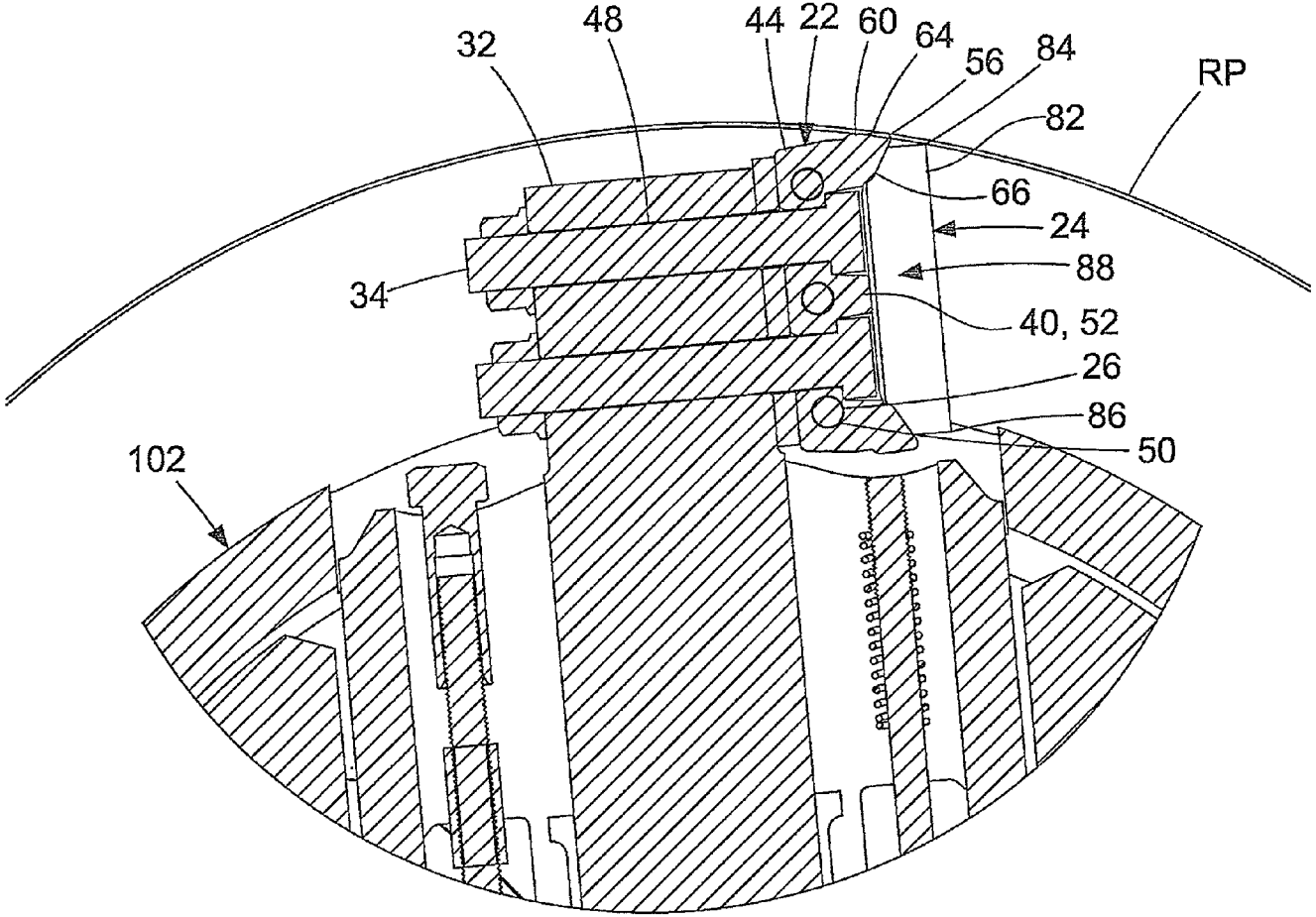
FIG. 5 is a cross-sectional view taken along section line 5-5 of FIG. 2.

Referring to FIG. 4, the reducing unit 102 includes a reducing component carrier in the form of a cylindrical drum 116 that is rotatable in a direction 118 about the axis of rotation 108. A plurality of the hammers 32 are mounted to the drum 116. The hammers 32 have end portions 119 that project radially outwardly from an outer cylindrical skin 120 of the drum 116. The reducing components 20 are mounted to leading faces of the end portions of the hammers 32. When the drum 116 is rotated about the axis 108, the hammers 32 and the reducing components 20 mounted thereto are carried around the axis of rotation 108 with outermost portions of the reducing components 20 defining the reducing perimeter RP of the reducing unit 102. As shown at FIG. 5, the outermost portions of the reducing components include the first reducing edges 56 of the block-style reducers 22 and the first ends 84 of the reducing edges 82 of the blade-style reducers 24. The entire lengths of the first reducing edges 56 are positioned at or in close proximity to the reducing perimeter RP so that the entire lengths of the first reducing edges 56 define the reducing perimeter RP. In contrast, the reducing edges 82 are oriented so that the lengths of the reducing edges 82 to extend inwardly from the reducing perimeter RP and only the first ends 84 are positioned at and define the reducing perimeter RP.

As shown at FIG. 5, the first reducing edges 56 of the block-style reducers 22 are positioned at the reducing perimeter and the second reducing edges 58 are inwardly offset from the reducing perimeter RP. The second reducing edges 58 are provided on the block-style reducers so that when the first reducing edges 56 become worn, the block-style reducers 22 can be removed from the hammers 32 and then remounted on the hammers 32 in a reverse configuration with the second reducing edges 58 positioned at the reducing perimeter RP.

Figure 6:
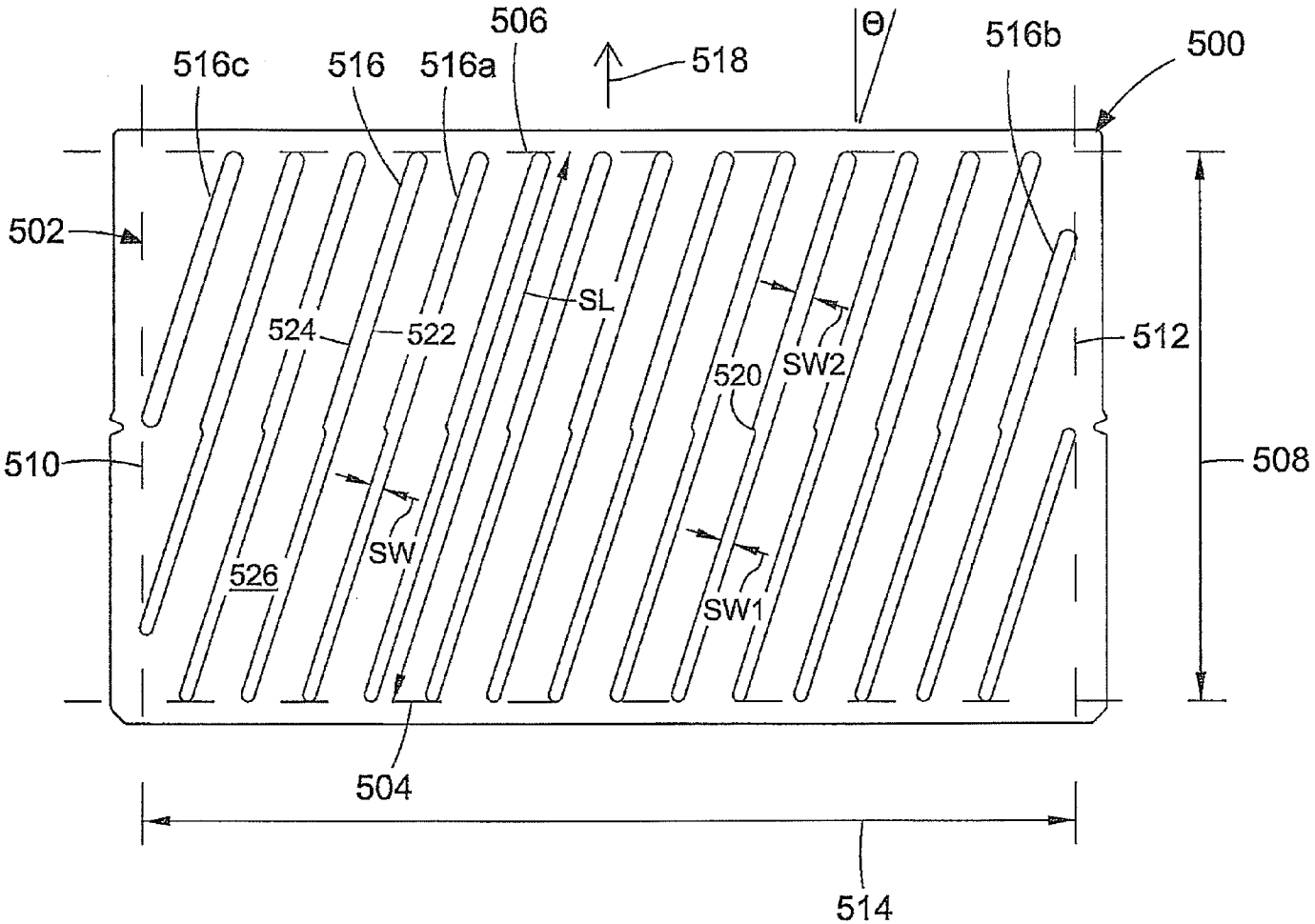
FIG. 6 is a plan view of the sizing screen of FIG. 4.

FIG. 6 is a plan view of an example configuration of the screen 500 suitable for use with the reducing unit 102. The screen 500 is adapted to at least partially to circumferentially surround the rotational reducing unit 102. The screen 500 includes a screening region 502 having an upstream-most boundary 504 separated from a downstream-most boundary 506 by an upstream-to-downstream screen dimension 508. When the screen 500 is mounted within a comminution machine, the upstream-to-downstream dimension is parallel to a direction of travel 518 of the material reducing components 20 of the comminution machine. The screening region 502 also has a first side boundary 510 (e.g., left side boundary) separated from a second side boundary 512 (e.g., a right side boundary) by a cross-screen dimension 514. The cross-screen dimension 514 is transversely oriented relative to the upstream-to-downstream screen dimension 508.

The screening region 502 includes a plurality of sizing slots 516 circumscribed by the boundaries 504, 506, 510 and 512 of the screening region 502. The sizing slots 516 have slot lengths SL and slot widths SW. The sizing slots 516 are elongated along the slot lengths SL such that the slot lengths SL are longer than the slot widths SW. The slot lengths SL of the sizing slots 516 are shown extending primarily along the upstream-to-downstream screen dimension 508 between the upstream-most boundary 504 and the downstream-most boundary 506. The slot widths SW are shown extending primarily along the cross-screen dimension 514 between the first side boundary 510 and the second side boundary 512. The sizing slots 516 are spaced-apart from one another (e.g., by lands) along the cross dimension 514. The sizing slots 516 are arranged inside the boundaries 504, 506, 510, 512 in a single row of parallel sizing slots that are spaced-apart from one another along the cross-screen dimension 514. The sizing slots 516 are continuously open (i.e., open without interruption) along their slot lengths.

The continuously open slot lengths of the sizing slots 516 preferably traverse a significant portion of the total length of the upstream-to-downstream screen dimension 508. The extended open construction of the sizing slots 516, which extends primarily in the upstream-to-downstream direction, assists in reducing the likelihood of plugging. Certain of the slots in accordance with the principles of the present disclosure have continuously open slot lengths that traverse more than 50 percent of the upstream-to-downstream screen dimension 508. Other slots in accordance with the principles of the present disclosure have continuously open slot lengths that traverse at least 75 percent of the upstream-to-downstream screen dimension 508. Still other slots in accordance with the principles of the present disclosure have continuously open slot lengths that traverse at least 90 percent of the upstream-to-downstream screen dimension 508. Further slots in accordance with the principles of the present disclosure have continuously open slot lengths that traverse the entire length of the upstream-to-downstream screen dimension 508 (i.e., 100 percent of the upstream-to-downstream screen dimension 508).

Referring to FIG. 6, slots of various lengths are shown. For example, slots 516*a* have continuously open slot lengths that traverse the full length of the upstream-to-downstream screen dimension 508. Thus, upstream ends of the slots 516*a* define the upstream-most boundary 504 of the screening region 502 and downstream ends of the slots 516*a* define the downstream-most boundary 506 of the screening region 502. Slots 516*b* have continuously open slot lengths that traverse 50 to 90 percent of the upstream-to-downstream screen dimension 508. Slots 516*c* have continuously open lengths that traverse less than fifty percent of the upstream-to-downstream screen dimension 508. The slots 516*a*, 516*b* and 516*c* are shown parallel to each other end and are shown extending primarily along the upstream-to-downstream screen dimension 508.

As used herein, the reducing component travel direction 518 is the direction, viewed in plan view (as shown at FIG. 6), in which the reducing components 20 move as the carrier carries the material reducing components along the cutting path from the upstream-most boundary to the downstream-most boundary of the screening region 502. The slot lengths SL of the sizing slots 516 are orientated at oblique angles θ relative to the reducing component travel direction 518. As shown at FIG. 6, the oblique angles θ are determined/measured from the plan view of the screen. In certain embodiments, the oblique angles θ are less than 45 degrees. In other embodiments, the oblique angles θ are in the range of 5-30 degrees. In still other embodiments, the oblique angles θ are in the range of 10-25 degrees. Similar to earlier disclosed embodiments, the slots can have a length to width ratio of at least 10 to 1, or at least 20 to 1, or at least 30 to 1.

It will be appreciated that the desired size of the angle θ is dependent upon the material being processed and the desired characteristics (e.g., size, flow characteristic, etc.) of the reduced material exiting the screen. For fibrous materials, it is generally preferred for the slots 516 to be obliquely angled relative to the reducing component travel direction 518. However, in other embodiments, the continuously open lengths of the sizing slots may be parallel to the reducing component travel direction 518.

Figure 7:
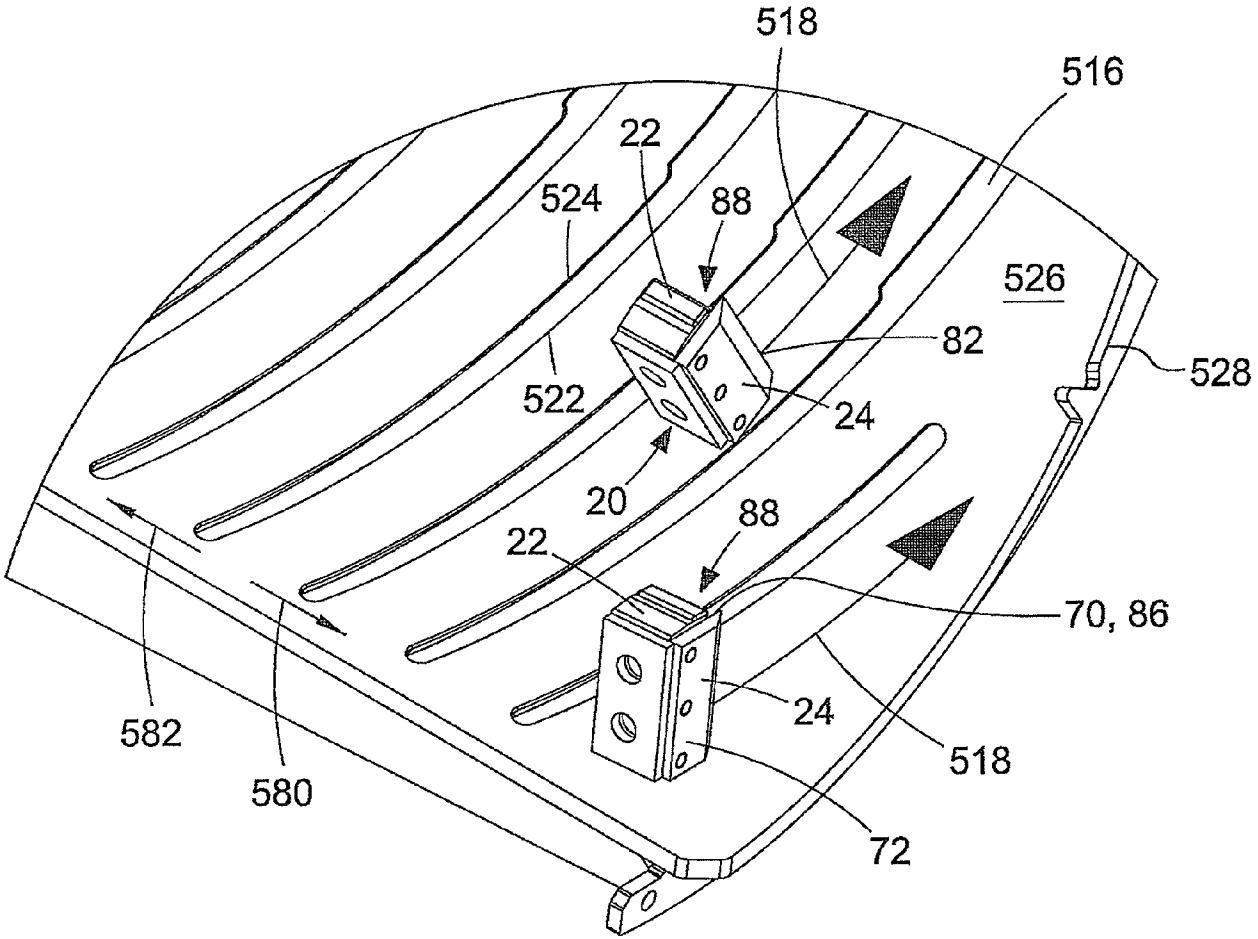
FIG. 7 shows a movement path of reducing components of the type depicted at FIG. 1 in relation to the screen of FIG. 6.
Figure 8:
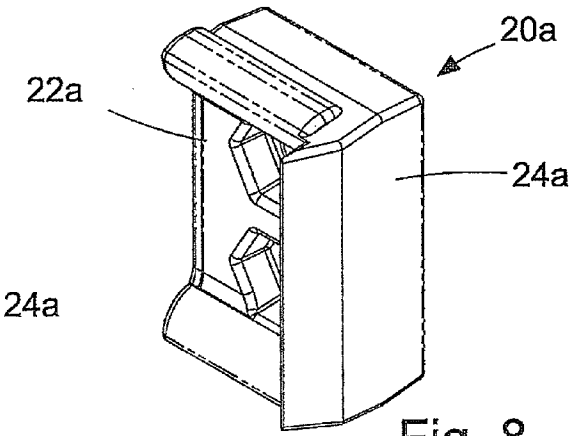
FIG. 8 is a perspective view of an alternative reducing component in accordance with the principles of the present disclosure.
Figure 9:
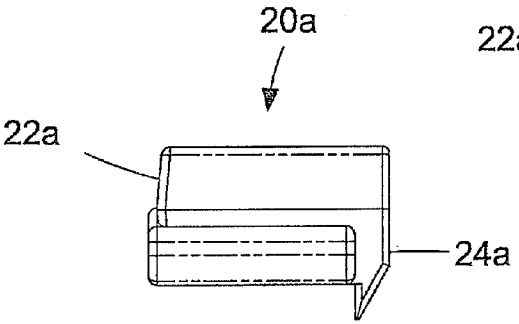
FIG. 9 is a top view of the reducing component of FIG. 8.
Figure 11:
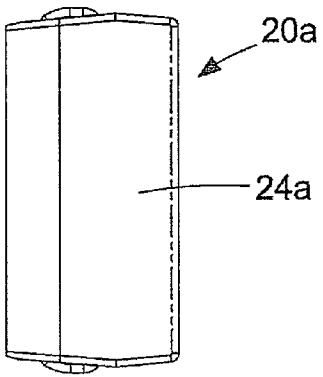
FIG. 11 is a side view of the reducing component of FIG. 8.
Figure 10:
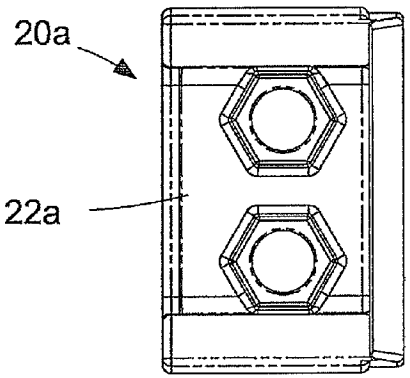
FIG. 10 is a front view of the reducing component of FIG. 8.

The sizing slots 516 have upstream slot-defining surfaces 522 that are opposed by downstream slot-defining surfaces 524. The upstream and downstream slot-defining surfaces 522, 524 are parallel to the slot lengths. As shown at FIG. 7, the slot-defining surfaces 522, 524 extend through the screen 500 from an inside surface 526 of the screen 500 to an outside surface 528 of the screen 500. The inside surface 526 of the screen 500 preferably faces toward the rotational reducing unit and circumferentially surrounds at least a portion of the rotational reducing unit.

Referring to FIG. 7, the front sides 40 of the block-style reducers 22 face primarily in the reducing component travel direction 518 (i.e., in a downstream direction) when the reducing components 20 are moved along the inside surface 526 of the screen 500. Movement of the reducing components 20 along the inside surface the screen is caused by rotation of the rotational cutting unit 102 in direction 118 about axis 108 thereby causing the reducing components to sweep along the reducing perimeter RP. As the reducing components 20 move along the reducing perimeter RP, the reducing components 20 sweep across the screening region 502 in an upstream-to-downstream direction. The reducing edges 56 of the reducing components 20 extend primarily along the axis of rotation 108 of the rotational reducing unit 102. The reducing edges 56 can also be described as extending primarily along the screen cross-dimension 514 and/or extending primarily along the slot widths SW. The blade-style reducers 24 project outwardly from the front sides 40 of the block-style reducers 22 in the reducing component travel direction 518. The forward portions of the first sides 70 of the blade-style reducers 24 face primarily toward the first side boundary 510 of the screening region 502. The blade-style reducers 24 are preferably positioned adjacent the sides of the hammers 32 that are closest to the second side boundary 512 of the screening region 502. In this way, the first sides 70 of the blade-style reducers 24 can be positioned to oppose the downstream slot-defining surfaces 524 of the slots 516.

The reducing edges 82 of the blade-style reducers 24 are shown extending primarily along radial axes of the hammers 32. The edges 82 can also be described as extending primarily radially outwardly from the inner surface 526 of the screen 500 and/or as extending primarily radially relative to the drum and/or the axis of rotation 108 of the rotational reducing unit 102. The reducing edges 82 of blade-style reducers 24 are positioned forwardly with respect to the reducing edges 56 of the block-style reducers 22. Thus, the reducing edges 82 lead the reducing edges 56 when the reducing components 20 are moved along the inside surface 526 of the screen 500 during reducing operations.

As shown at FIG. 7, the oblique angling of the sizing slots 516 relative to the reducing component travel direction 518 causes the slots 516 to extend in a first lateral direction 580 as the slots 516 traverse the upstream-to-downstream dimension 508 in downstream direction. The first sides 70 of the blade-style reducers 24 face primarily in a second lateral direction 582 that is opposite from the first lateral direction 580. The first sides 70 also oppose the downstream slot-defining surfaces 524 of the sizing slots 516. Similarly, the front sides 40 of the block-style reducers 22 face at least partially toward and oppose the downstream slot-defining surfaces 524 of the sizing slots 516. The open sides 90 of the pockets 88 of the reducing components 20 face in the second lateral direction 582. This pocket configuration assists in encouraging material being reduced to be forced against the downstream slot-defining surfaces 524 of the sizing slots 516, For example, the configuration of the pockets inhibits material from flowing off of the front sides 40 of the block-style reducers 22 in the first lateral directions 580 and allows material to flow off of the front sides 40 of the block-style reducers 22 in the second lateral directions 582. This causes the material to be encouraged in the second lateral direction 582 and forced against the downstream slot-defining surfaces 524. It will be appreciated that the second lateral direction 582 opposes the downstream slot-defining surfaces 524.

During material reduction, the reducing components 20 are swept circumferentially along the inner surface 526 of the screen 500 with a gap/clearance between the reducing perimeter RP and the inner surface 526 of the screen. In certain embodiments, the gap is at least 0.25 inches. In other embodiments, the gap is in the range of 0.25-0.5 inches. In the depicted embodiment, no portions of the reducing components pass through or otherwise enter the sizing slots 516. In other words, the material reducing perimeter RP is inwardly offset from the inner circumferential surface 526 of the screen 500 such that no portions of the material reducing components enter the sizing slots during material reduction. In the depicted embodiment, the material reducing components 20 have reducing component widths which extend primarily along the slot widths and are larger than the slot widths.

Figure 12:
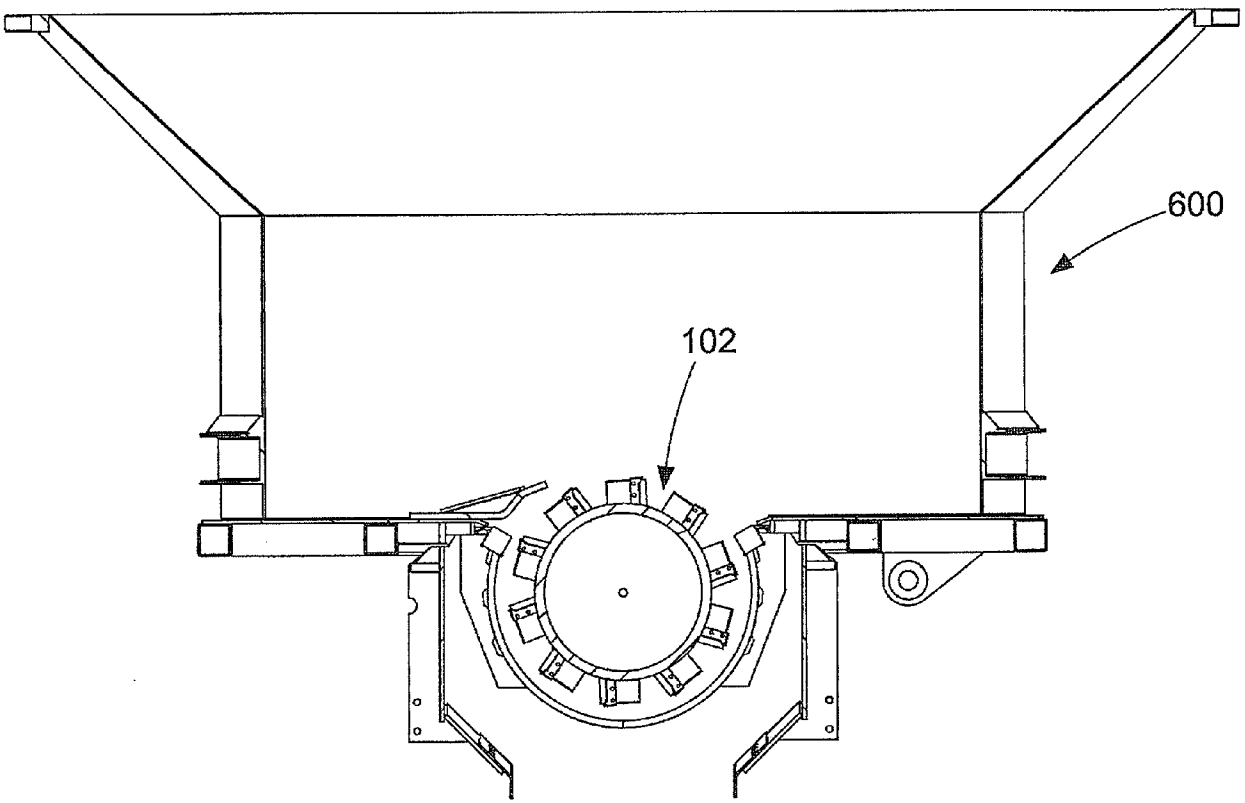
FIG. 12 shows the rotational reducing unit of FIG. 4 incorporated into a tub grinder.
Figure 13:
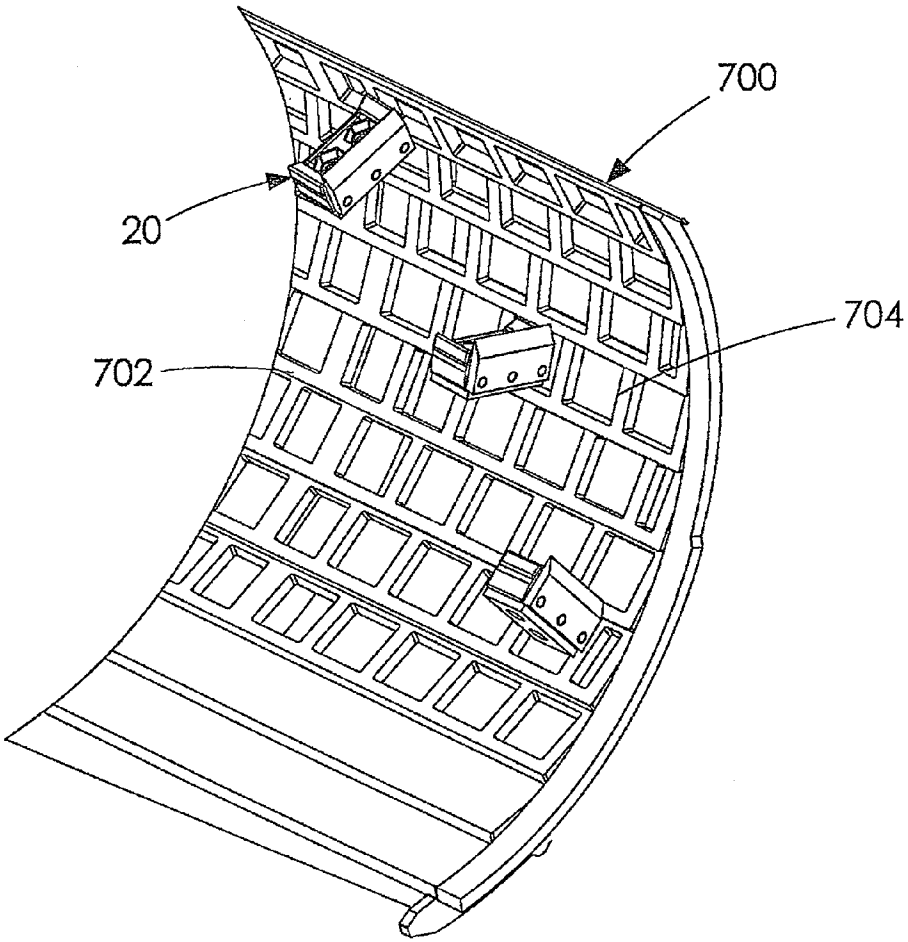
FIG. 13 shows reducing components of the type depicted at FIG. 1 shown in use with an another screen style.
Figure 14:
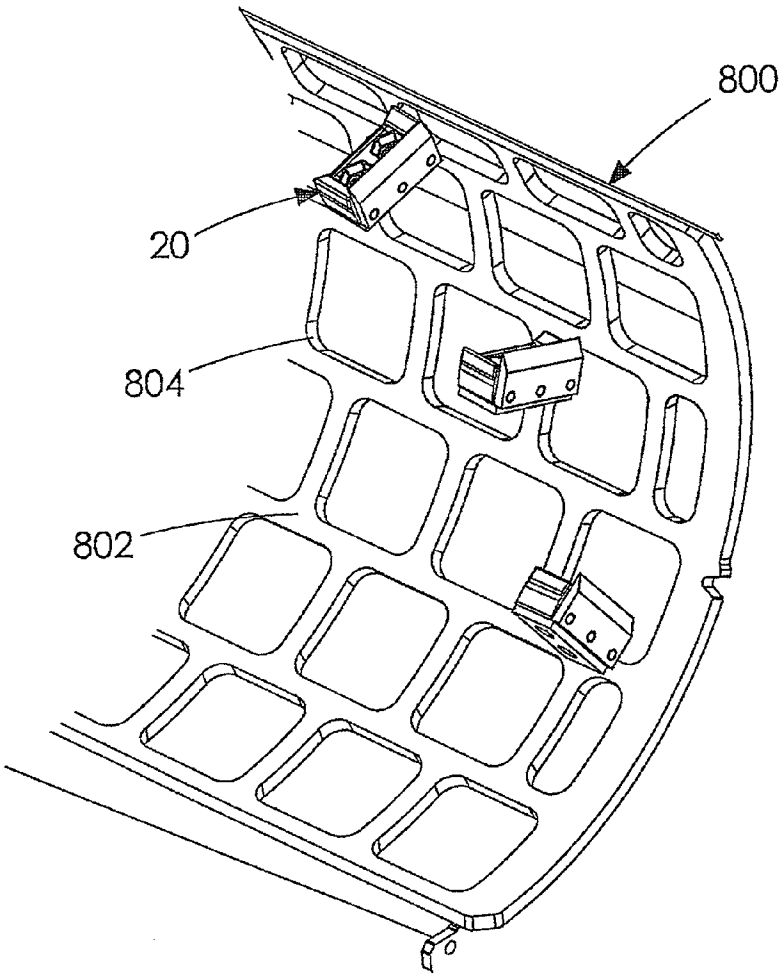
FIG. 14 shows reducing components of the type depicted at FIG. 1 shown in use with a further screen style.

It will be appreciated that reducing components and reducing units in accordance with the principles of the present disclosure can be used with comminution machines (e.g., horizontal grinders, vertical grinders, tub grinders, chippers, etc.) having various types of in-feed and discharge systems. FIG. 12 shows the reducing component 102 incorporated into a tub grinder 600. Further details of the tub grinder in-feed and discharge systems are disclosed at U.S. Pat. No. 5,950,942, which is incorporated by reference herein in its entirety. It will also be appreciated that reducing components and reducing units in accordance with the principles of the present disclosure can also be used with a variety of different types/styles of screens having a variety of types/shapes of sizing openings. FIG. 13 shows reducing components 20 used in combination with a screen 700 having a stepped inner face 702 and generally rectangular (e.g., generally square) sizing openings 704. FIG. 14 shows reducing components 20 used in combination with a screen 800 having a smooth inner face 802 and generally rectangular (e.g., generally square) sizing openings 804.

As used herein, the phrase "primarily along" a reference axis, dimension or structure means for the most part along (i.e., with 45 degrees of) the reference axis, dimension or structure. Also, the phrase "extending primarily radially" with respect to a reference axis, dimension or structure means extending for the most part in a radial direction from or toward from the reference axis, dimension or structure. Also, the phrase "generally parallel" means parallel or almost parallel. Further, the phrase "generally perpendicular" means perpendicular or almost perpendicular.

From the foregoing detailed description, it will be evident that modifications and variations can be made in the machine of the disclosure without departing from the spirit and scope of the disclosure.

What is claimed is:

1. A reducing component comprising:

a block-style reducer including a height, a width and a depth, the block-style reducer including first and second ends separated by the height, first and second sides separated by the width and front and back sides separated by the depth, the block-style reducer including a first reducing edge that extends across the width of the block-style reducer at a location adjacent to the first end of the block-style reducer; and a blade-style reducer that projects forwardly from the block-style reducer at a location adjacent the second side of the block-style reducer, the blade-style reducer including a second reducing edge that extends primarily along the height of the block-style reducer.

2. The reducing component of claim 1, wherein the first reducing edge is defined by wedge-like element that projects forwardly from a main front face of the block-style reducer.

3. The reducing component of claim 2, wherein the second reducing edge is forwardly offset relative to the first reducing edge.

4. The reducing component of claim 1, wherein the second reducing edge is generally parallel to the height of the block-style reducer, and wherein the first reducing edge is generally perpendicular relative to the height of the block-style reducer.

5. The reducing component of claim 1, wherein the first reducing edge is a blunt edge.

6. The reducing component of claim 1, wherein the second reducing edge is a knife edge.

7. The reducing component of claim 1, wherein the second reducing edge is sharper than the first reducing edge.

8. The reducing component of claim 1, wherein the block-style reducer includes a third reducing edge that extends across the width of the block-style reducer at a location adjacent to the second end of the block-style reducer.

9. The reducing component of claim 1, wherein the blade-style reducer is attached to the second side of the block-style reducer with one or more fasteners.

10. The reducing component of claim 9, wherein the one or more fasteners extend through the block-style reducer along the width of the block-style reducer.

11. The reducing component of claim 1, wherein the blade-style reducer is integrally formed as a single piece with the block-style reducer.

12. A comminution machine comprising:

a reducing unit including a carrier that is rotatable about an axis of rotation;

a plurality of hammers carried by the carrier, the hammers having leading faces; and a plurality of reducing components that cover the leading faces of the hammers, the reducing components each comprising:

a block-style reducer including a height, a width and a depth, the block-style reducer including first and second ends separated by the height, first and second sides separated by the width and front and back sides separated by the depth, the block-style reducer including a first reducing edge that extends across the width of the block-style reducer at a location adjacent to the first end of the block-style reducer; and a blade-style reducer that projects forwardly from the block-style reducer at a location adjacent the second side of the block-style reducer, the blade-style reducer including a second reducing edge that extends primarily along the height of the block-style reducer.

13. The comminution machine of claim 12, further comprising a screen at least partially surrounding the reducing unit.

14. The comminution machine of claim 13, wherein the reducing components define a reducing perimeter when the carrier is rotated about the axis of rotation, and wherein the reducing perimeter is inwardly offset from an inner surface of the screen.

15. The comminution machine of claim 14, wherein the first reducing edges have lengths that are generally on the reducing perimeter, and wherein the second reducing edges have lengths that extend inwardly from the reducing perimeter.

16. The comminution machine of claim 15, wherein the second reducing edges are forwardly offset from the first reducing edges, and wherein ends of the second reducing edges are located generally at the reducing perimeter.

* * * * *